US005823614A

United States Patent [19]

Johnson et al.

[11] Patent Number: 5,823,614

[45] Date of Patent: Oct. 20, 1998

[54] THREE-WAY RECLINING FURNITURE ITEM

[75] Inventors: Terry Johnson, Mantachie; Mike Hartline, Saltillo; Nikki White, Pontotoc, all of Miss.

[73] Assignee: L&P Property Management Company, Chicago, Ill.

[21] Appl. No.: 971,804

[22] Filed: Nov. 17, 1997

Related U.S. Application Data

[63] Continuation-in-part of Ser. No. 664,000, Jun. 14, 1996, abandoned.

[51] Int. Cl.[6] ..... A47C 1/02; A61G 15/00

[52] U.S. Cl. ..... 297/85; 297/68; 297/84; 297/452.4

[58] Field of Search ..... 297/85, 452.4, 297/68, 84, 452.2

[56] References Cited

U.S. PATENT DOCUMENTS

| | | |
|---|---|---|
| Re. 29,483 | 11/1977 | Ré . |
| Re. 34,666 | 7/1994 | Tacker . |
| 361,804 | 4/1887 | Babka . |
| 1,792,247 | 2/1931 | Schauss . |
| 1,896,048 | 1/1933 | Grinnell . |
| 2,015,138 | 2/1935 | Drake . |
| 2,302,387 | 11/1942 | Greeno . |
| 2,473,895 | 9/1949 | Mednick . |
| 2,615,499 | 10/1952 | Wallace . |
| 2,749,970 | 6/1956 | Quakenbush . |
| 2,888,977 | 6/1959 | Thaden . |
| 2,895,538 | 7/1959 | Lorenz . |
| 2,906,318 | 9/1959 | Schliephacke . |
| 2,909,213 | 10/1959 | Winick . |
| 3,068,047 | 12/1962 | Schliephacke . |
| 3,080,192 | 3/1963 | Lorenz . |
| 3,121,590 | 2/1964 | Schliephacke . |
| 3,179,466 | 4/1965 | Garrett . |
| 3,191,990 | 6/1965 | Rugg et al. . |
| 3,363,942 | 1/1968 | Fletcher . |
| 3,582,135 | 6/1971 | Fletcher . |
| 3,622,198 | 11/1971 | Ré . |
| 3,730,585 | 5/1973 | Rogers, Jr. et al. . |
| 3,743,348 | 7/1973 | Sloan . |
| 3,747,973 | 7/1973 | Re . |
| 3,758,151 | 9/1973 | Re . |
| 3,759,572 | 9/1973 | Koepke ..... 297/452.4 |
| 3,767,257 | 10/1973 | Rogers, Jr. et al. . |
| 3,802,735 | 4/1974 | Ré . |
| 3,856,346 | 12/1974 | Herman . |
| 3,858,932 | 1/1975 | Crum et al. . |
| 3,869,169 | 3/1975 | Johnson et al. . |
| 3,874,724 | 4/1975 | Ré . |
| 3,958,827 | 5/1976 | Ré . |
| 4,072,342 | 2/1978 | Johnson et al. . |

(List continued on next page.)

FOREIGN PATENT DOCUMENTS

| | | |
|---|---|---|
| 701781 | 12/1940 | Germany . |
| 1010702 | 6/1957 | Germany . |
| 603980 | 6/1948 | United Kingdom . |
| 775679 | 5/1957 | United Kingdom . |

*Primary Examiner*—Peter M. Cuomo
*Assistant Examiner*—Rodney B. White
*Attorney, Agent, or Firm*—Wood, Herron & Evans, L.L.P.

[57] ABSTRACT

A reclining furniture item including a reclining mechanism employing a roller and track system which significantly reduce the number of linkages and provide a zero or near zero wall proximity feature. Various embodiments are contemplated which include a moveable seat link mounted on rollers which move along angled track sections. These rollers form the major connection made between the moveable seat link and the stationary base member. At least one of the tracks is formed with two angled sections. The first angled section is sloped downwardly from rear to front and the second section is sloped upwardly from rear to front. Backrest linkage is also provided for allowing angling of the backrest with respect to the seat during reclining movement. Footrest linkage is connected to the front of the mechanism for extension and retraction in moving between a fully upright and a reclined T.V. position.

49 Claims, 8 Drawing Sheets

U.S. PATENT DOCUMENTS

| | | | |
|---|---|---|---|
| 4,185,869 | 1/1980 | Rogers et al. . | |
| 4,186,960 | 2/1980 | Mizelle . | |
| 4,195,878 | 4/1980 | Cycowicz et al. . | |
| 4,202,580 | 5/1980 | Johnson . | |
| 4,212,495 | 7/1980 | Gall . | |
| 4,364,603 | 12/1982 | Johnson . | |
| 4,531,778 | 7/1985 | Rogers, Jr. . | |
| 4,668,009 | 5/1987 | Talley et al. . | |
| 4,740,031 | 4/1988 | Rogers, Jr. . | |
| 4,805,960 | 2/1989 | Tacker . | |
| 4,815,788 | 3/1989 | May . | |
| 4,878,710 | 11/1989 | Tacker . | |
| 4,904,019 | 2/1990 | May . | |
| 4,989,914 | 2/1991 | Pine | 297/85 |
| 5,011,220 | 4/1991 | LaPointe . | |
| 5,022,707 | 6/1991 | Beauvais et al. . | |
| 5,056,862 | 10/1991 | May et al. . | |
| 5,072,988 | 12/1991 | Plunk . | |
| 5,090,768 | 2/1992 | Re et al. | 297/85 |
| 5,129,701 | 7/1992 | Pine et al. | 297/85 X |
| 5,147,108 | 9/1992 | LaPointe . | |
| 5,217,276 | 6/1993 | LaPointe et al. . | |
| 5,234,253 | 8/1993 | LaPointe et al. . | |
| 5,271,660 | 12/1993 | LaPointe et al. . | |
| 5,292,170 | 3/1994 | LaPointe et al. . | |
| 5,312,153 | 5/1994 | Lin . | |
| 5,354,116 | 10/1994 | May et al. | 297/85 |
| 5,360,255 | 11/1994 | Cook et al. . | |
| 5,388,886 | 2/1995 | LaPointe . | |
| 5,419,611 | 5/1995 | Cook | 297/85 |
| 5,427,431 | 6/1995 | Saul et al. . | |
| 5,449,218 | 9/1995 | Beauvais et al. . | |
| 5,480,213 | 1/1996 | Sproule | 297/85 X |
| 5,485,979 | 1/1996 | LaPointe et al. . | |
| 5,564,786 | 10/1996 | Peek et al. | 297/452.4 |
| 5,570,927 | 11/1996 | LaPointe et al. | 297/85 |
| 5,582,457 | 12/1996 | Komorowski et al. | 297/85 X |
| 5,595,420 | 1/1997 | Rogers | 297/85 |

THREE-WAY RECLINING FURNITURE ITEM

This application is a continuation-in-part of application Ser. No. 08/664,000, filed on Jun. 14, 1996 now abandoned.

The disclosure of U.S. application Ser. No. 08/664,000 is hereby fully incorporated by reference herein.

BACKGROUND OF THE INVENTION

This invention generally relates to reclining furniture and, more specifically, to a three-way reclining furniture item having a moveable seat, backrest and footrest.

Conventional reclining furniture items, such as chairs, sofas and sectionals, generally have either two-way or three-way mechanisms for allowing the chair to be moved between upright and reclined positions. In a two-way mechanism, the seat is fixed to the backrest as a unitary structure so that the angle therebetween remains the same during reclining motion. If the piece of furniture has a three-way mechanism, the top of the backrest will angle downwardly and rearwardly relative to the seat as the piece of furniture moves from an intermediate reclined or "T.V." position to a fully reclined position. Likewise, the backrest will move or tilt back up as the chair moves from the fully reclined position to the T.V. position. One major problem with existing three-way reclining mechanisms has been their complexity and cost. Generally, these mechanisms comprise large numbers of linkages and pivots. Understandably, the more linkages and pivot connections in a given reclining mechanism, the higher the cost of manufacture and assembly.

It has also become conventional practice to design reclining mechanisms with a "zero wall proximity" ability. This refers to the ability to place the item of furniture with the top of the backrest against or very close to a wall while still allowing movement of the furniture item into both intermediate and fully reclined positions without encountering interference from the wall. Generally, the addition of this feature to a mechanism has even further complicated the typical three-way reclining mechanism. Another problem associated with typical three-way reclining mechanisms has been the noise and abrupt or rough movements that they produce in moving between the various chair positions. Again, this noise can be associated with the numerous moving linkages in the mechanisms.

There have been many attempts to incorporate rollers in reclining mechanisms in various ways to produce mechanisms allowing reclining furniture to be placed closely adjacent to a wall. For example, see U.S. Pat. Nos. 3,874,724; 4,072,342; 4,364,603; and 4,531,778. Each of the mechanisms and associated furniture items disclosed in these patents suffers from various disadvantages. Generally stated, none of these mechanisms fully utilize the potential for a roller and track system to take the place of a significant number of linkages while retaining the ability to move a chair between three comfortable positions in a smooth manner and without interfering with a closely adjacent wall. Some rely on rollers during initial movement of the chair, such as Johnson, U.S. Pat. No. 4,364,603 and some rely on rollers only in moving from the intermediate position to the fully reclined, such as Rogers, Jr., U.S. Pat. No. 4,531,778. Still others, such as U.S. Pat. Nos. 3,874,724 and 4,072,342 utilize rollers during the entire movement of the chair, however, these rollers are still part of rather complex mechanisms.

Prior mechanisms have also failed to adequately utilize rollers and tracks to assist the linkage assembly and the seat occupant in moving between the various positions. In this regard, many prior mechanisms that incorporate rollers simply use the rollers as guides during forward movement. They do not generally assist enough during movements or fulfill the dual purposes of guiding movement of the mechanism and providing pivot points and temporary stops during such movement. Finally, it would be desirable to provide a mechanism having a roller and track system that assists the seat occupant during all phases of movement, while still retaining a relatively low cost design.

In view of the problems with conventional three-way reclining mechanisms including those using rollers, it would be desirable to simplify these mechanisms by significantly reducing the number of links to reduce both the costs and the noise associated with the mechanisms. At the same time, it would be advantageous to provide a mechanism which fully reclines in a smooth manner without significant effort by the seat occupant and without interfering with a closely adjacent wall.

SUMMARY OF THE INVENTION

The present invention improves upon past three-way reclining mechanisms by incorporating a roller and track system which substitutes for many typical linkages associated with moving the furniture item from a fully upright position, through an intermediate or T.V. position and finally into a fully reclined position. The roller and track system associated with the various embodiments of this invention includes at least one track with a first sloped section and a second sloped section. The two track sections are sloped in opposite directions with a generally angled intersection therebetween. The first section is sloped downwardly from rear to front while the second section is sloped upwardly from rear to front. The roller and track engage and one moves with respect to the other during movement from the upright position to the intermediate or T.V. position and during movement from the intermediate or T.V. position into the fully reclined position. During movement along the first track section, the rear of the seat angles downwardly and moves forwardly. During subsequent full recline movement along the second track section, the seat moves upwardly and forwardly. These motions allow the furniture item to be placed with the backrest in close proximity to a wall. Also, the generally angled intersection between the first and second track sections creates a firm stopping point for the first roller at the intermediate or TV position. This helps prevent the chair from inadvertently slipping past the intermediate or TV position as the chair occupant opens the chair up from the fully upright position.

In a first embodiment of this invention, the track system is formed as part of the stationary base of the furniture item. In a preferred manner, the differently sloped track sections are formed on a base member or link which is rigidly fixed to a stationary wooden frame of the furniture item. It is contemplated, however, that in this embodiment the track system may be formed as part of the chair frame. At least one roller is connected for rotation to a seat link such that the seat link rides along the track by way of the roller. Preferably, two rollers and two different tracks are provided to support front and rear portions of the seat link. Backrest linkage is provided for supporting a backrest from the seat link and the base member. Also, footrest linkage is provided at the forward end of the seat link and is moveable between fully extended and fully retracted positions with the movement of the seat link. Footrest actuating linkage is provided between the seat link and the base member. The footrest actuating linkage is connected to the footrest linkage such that forward movement of the seat link during a movement into the intermediate or T.V. position actuates the footrest linkage into the fully extended position.

The operation of a furniture item constructed in accordance with the first embodiment is initiated when the user actuates a latch mechanism to release the seat link when the furniture item is in a fully upright position. Once released, the weight of the occupant causes the rollers to move down the first sloped track section to the intersection between the first and second track sections. During this movement, the footrest linkage is actuated into its fully extended position. Movement of the seat link and the attached seat in a forward direction also moves the backrest in a forward direction away from any wall which may be in close proximity. Movement of the furniture item into a fully reclined position is initiated by the seat occupant placing rearward pressure on the backrest to angle the backrest with respect to the seat and move the seat link and attached rollers up the second sloped track section in a forward direction. Because of the continued forward movement of the seat and backrest in this manner, the backrest still does not interfere with a wall in close proximity to the chair despite being at a greater angle relative to the seat. Movement back into the intermediate position is accomplished by simply releasing pressure from the backrest. This causes the rollers to roll back down the second track section to the intersection between the two track sections. Movement into the fully upright position is initiated by the occupant placing downward pressure on the footrest to move the footrest into a retracted position. This also moves the rollers up the first inclined track section to their initial starting points until the latch mechanism is engaged.

In a second embodiment, the track system is incorporated into a seat supporting member, which may or may not be a linkage member. The rollers in this embodiment are fixed and stationary, such as by being affixed to a stationary base member or directly to a frame member of the furniture item. In the second embodiment, at least one track is provided again with two differently sloped track sections. In each embodiment, the first track section is sloped downwardly in a forward direction and the second track section is sloped upwardly in a forward direction. Like the first embodiment, backrest linkage is provided between the seat member and the base member for allowing the backrest to angle with respect to the seat and footrest linkage is provided at the forward end of the seat member to allow a footrest to be extended and retracted.

The operation of the second embodiment is similar to the first embodiment except that the track system moves along the stationary rollers instead of vice versa as in the first embodiment. Therefore, during movement from the fully upright position to the intermediate or T.V. position, the first track section of each track associated with the seat member moves along a respective roller in a downward and forward direction while also carrying the seat. This downward and forward movement of the seat and seat member actuates the footrest linkage through appropriate actuating linkage in the manner of the first embodiment. To cause the furniture item to move into the fully reclined position, the occupant applies rearward pressure to the seat back angling it with respect to the seat and, at the same time, moving the seat member in a forward direction such that the second track section moves upward in a forward direction along a respective roller. Preferably, each mechanism of the invention includes front and rear tracks and corresponding rollers.

Another advantageous aspect of the second embodiment is that the seat member may be formed as part of a tubular frame with each of the side tube members including the front and rear tracks formed by first and second track sections as discussed above. This tubular seat frame or seat member may be formed in a plurality of, for example, two sections which are preferably connected together in an adjustable fashion. In addition to ease of manufacture and assembly, this construction thereby also provides for adjustment in size of the seat frame by simply adjusting the connection between the seat members.

In a third embodiment, the second track is formed as a single, straight track while the first track is angled generally as described above. The second track is sloped upwardly from rear to front. This second track is disposed in a front portion of the mechanism while the first, angled track is disposed in the rear portion of the mechanism. Advantageously, the rollers are used independently during movement from the upright position to the intermediate or TV position. That is, the first roller moves downward on the first track while the second roller remains stationary to act as a linkage pivot point. Then, during further movement to the fully reclined position, both rollers move relatively forward and upward along the tracks. It is contemplated that a reversal of parts may be incorporated into the roller and track system of the third embodiment as is generally shown in the second embodiment. As with the first two embodiments, appropriate footrest, backrest and actuating linkages are provided in the third embodiment of the mechanism.

The operation of a furniture item constructed with a three-way reclining mechanism in accordance with the third embodiment is initiated when the user actuates a latch mechanism. The latch mechanism forces the footrest linkage to extend and, with the weight of the seat occupant, moves the seat supporting linkage over center and in a forward direction. The first roller moves downward on the first sloped section of the first track and assists in moving the chair in a forward direction away from a wall. The second roller remains stationary at the lower end of the second track and acts as a pivot point for a front pivot link of the seat supporting linkage during the movement from the fully upright to the intermediate or TV position. Movement of the furniture item to a fully reclined position is initiated by the seat occupant placing rearward pressure on the backrest to angle the backrest with respect to the seat and move the seat link, seat supporting linkage, and the first and second rollers up the second track section of the first track and up the second track, each in a forward direction. Because of the continued forward movement of the seat and backrest in this manner, the backrest still does not interfere with a wall in close proximity to the back of the chair despite being at a greater angle relative to the seat.

Like the first two embodiments, movement back into the intermediate or TV position is obtained by simply releasing pressure from the backrest. This causes the first and second rollers to simultaneously roll back down the first and second tracks. That is, the first roller rolls down the second sloped track section to the generally angled intersection between the two track sections and the second roller rolls down the length of the second track to the initial starting position. Movement into the fully upright position is initiated by the seat occupant placing downward pressure on the footrest to move the footrest into a retracted position. This also moves the first roller up the first sloped track section to its initial starting point while the second roller again acts as a pivot point for the seat supporting linkage until the footrest linkage is fully locked into a retracted position.

Additional advantages and objectives of this invention will be recognized upon review of the following detailed description and accompanying drawings.

DETAILED DESCRIPTION OF THE PREFERRED EMBODIMENTS

Figure 1:
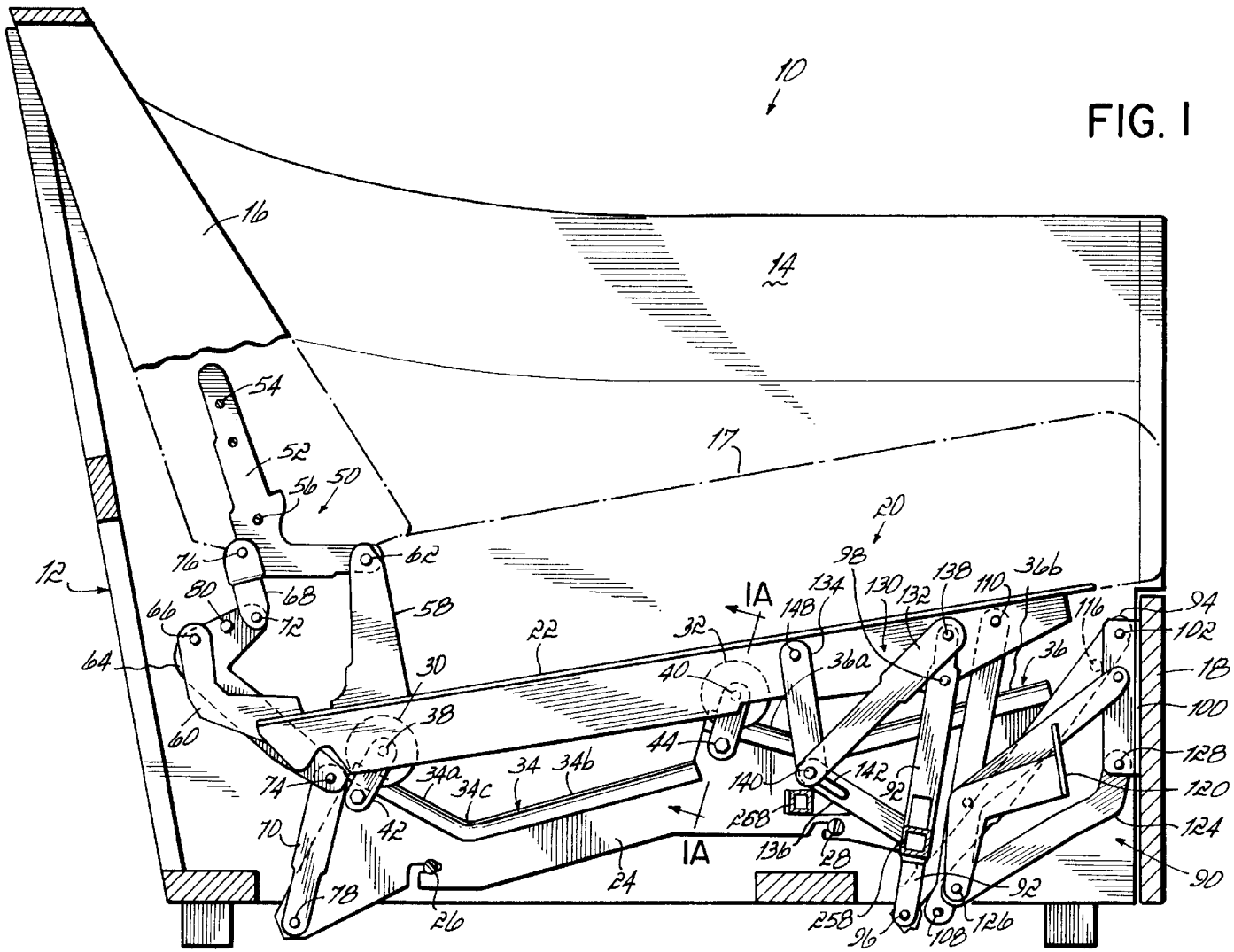
FIG. 1 is a side cross-sectional view of a schematically illustrated furniture item incorporating a reclining mechanism constructed in accordance with a first embodiment of this invention but eliminating the seat latching mechanism for clarity.

Referring first to FIG. 1, an item of furniture 10 is shown and includes a stationary base frame 12 having an arm frame portion 14. Furniture item 10 further includes a moveable backrest 16 and a moveable seat 17 and footrest 18. Furniture item 10 may be a reclining chair or sofa or any type of so-called action furniture which utilizes a seat, backrest and footrest moveable between upright, intermediate or T.V. and fully reclined positions. To accomplish the movement of furniture item 10 between these three positions, the furniture item 10 incorporates an improved linkage mechanism 20 constructed in accordance with the present invention. Only one mechanism 20 is shown and described with the understanding that furniture item 10 includes another mechanism on the other side being a mirror image of mechanism 20.

Linkage Mechanism of the First Embodiment

A first embodiment of linkage mechanism 20 includes a moveable seat link 22 and a stationary base member or link 24. Base member 24 is rigidly affixed to chair frame 12 by suitable threaded fasteners 26, 28. A pair of rollers 30, 32 are mounted between seat link 22 and base member 24 to form a rolling connection therebetween. Specifically, rollers 30, 32 roll along a pair of tracks 34, 36 formed on stationary base member 24. Each track 34, 36 has first and second track sections 34*a*, 34*b* and 36*a*, 36*b* separated by respective generally angled intersections 34*c*, 36*c*. It will be appreciated that stationary base member 24 is shown as a separate link in this first embodiment, however, base member 24 may instead be an integral part of chair frame 12 or, more specifically, arm frame structure 14.

Figure 1A:
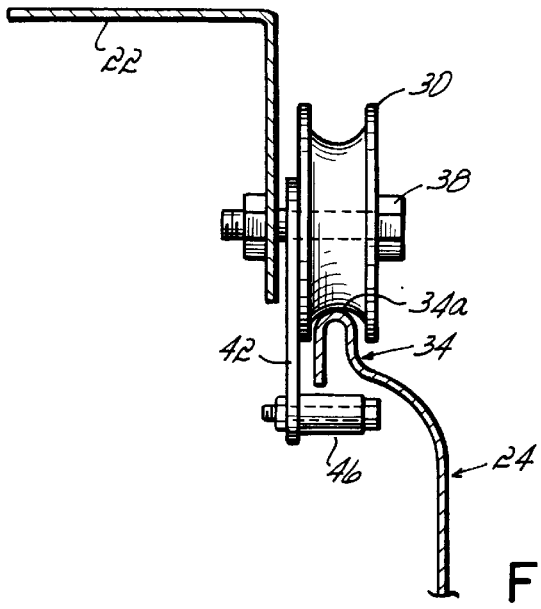
FIG. 1A is a cross-sectional view taken along line 1A—1A of FIG. 1.

In the first embodiment as shown in FIGS. 1 and 1A, rollers 30, 32 are connected for rotation with respect to seat link 22 by respective roller mounts 38, 40. Respective guide members 42, 44 extend from pivot mounts 38, 40 and include rolling followers (only one follower 46 being shown in FIG. 1A) at opposite ends thereof. It will therefore be appreciated that rollers 30, 32 respectively engage and roll along an upper surface of the respective tracks 34, 36 while rolling followers 46 may engage and roll along the respective lower surfaces of tracks 34, 36. As shown, the followers 46 do not normally contact base member 24 since their main function is to keep the seat 17 from being lifted from furniture item 10.

Linkage mechanism 20 further includes backrest linkage 50 generally connected between backrest 16, seat link 22 and base member 24. Backrest linkage 50 supports the backrest frame 16 for pivotal movement relative to seat link 22 and an attached seat 17. Backrest linkage 50 includes a backrest link 52 rigidly affixed to backrest frame 16 by suitable fasteners 54, 56. Many different configurations for backrest linkage 50 may be chosen and utilized in linkage mechanism 20 of the present invention, however, the presently contemplated linkage includes a pair of support members 58, 60 rigidly affixed to a rear end of seat link 22. An upper end of support link 58 is connected to backrest link 52 by a pivot connection 62. An upper end of support link 60 is connected to a backrest actuating link 64 by a pivot connection 66. Backrest actuating link is part of further actuating and supporting linkage including upper and lower links 68, 70 connected by respective pivot connections 72, 74 at opposite ends of actuating link 64. Upper actuating link 68 is also connected to backrest link 52 by a pivot connection 76 and lower actuating link 70 is also connected to base member 24 by a lower pivot connection 78 to complete the connection between backrest frame 16, seat link 22 and base member 24 or frame 12. Backrest actuating link 64 further includes a stop stud 80 for limiting reclining motion of backrest frame 16 in a manner to be described.

Figure 2:
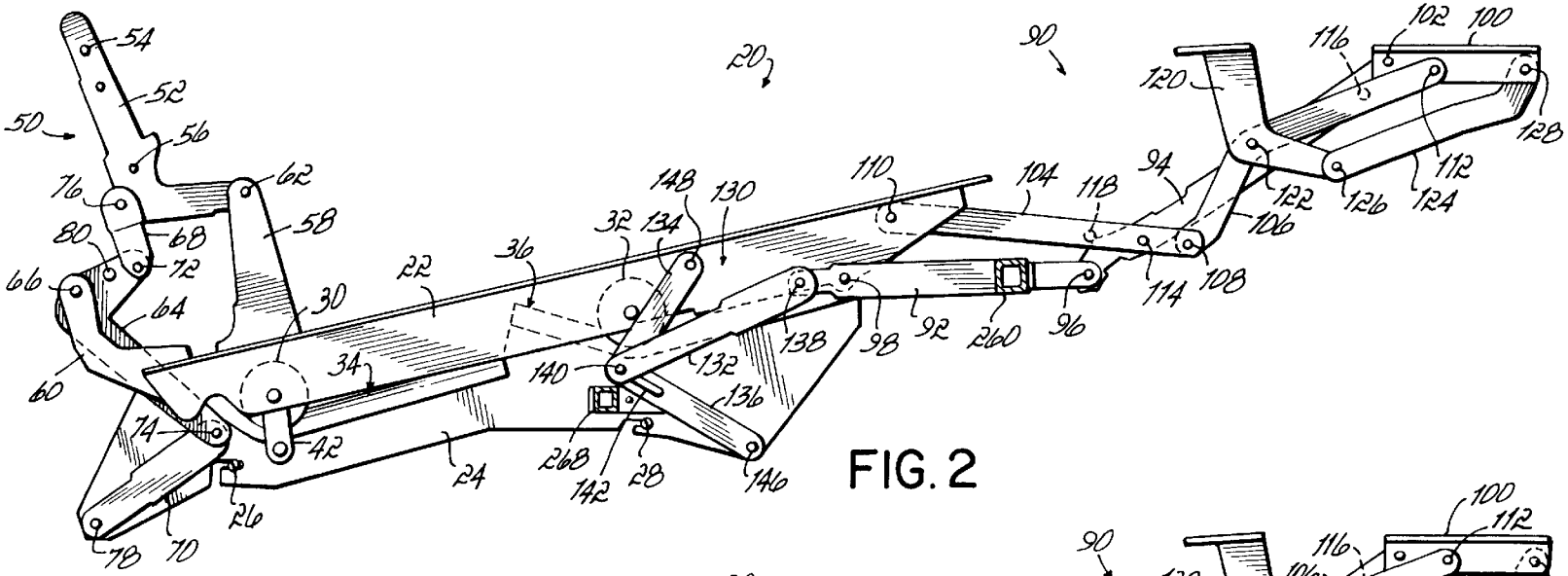
FIG. 2 a side elevational view of the mechanism shown in FIG. 1, eliminating the furniture item for clarity, and showing the mechanism in an intermediate or T.V. position.
Figure 3:
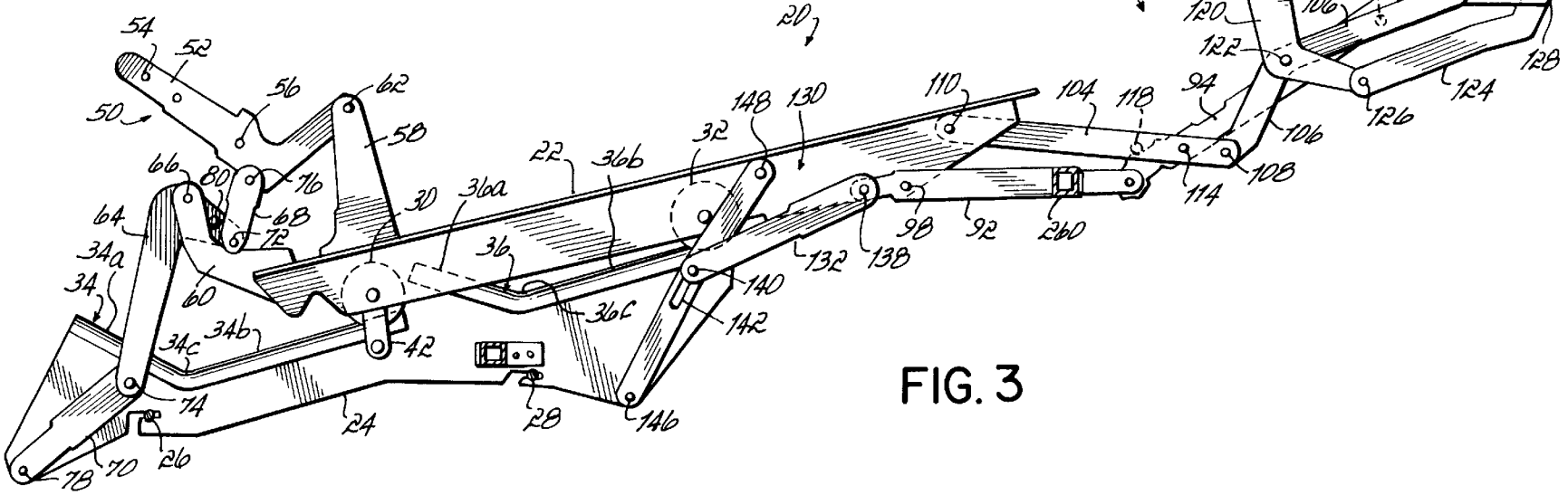
FIG. 3 is a side elevational view of the mechanisms of FIGS. 1 and 2 but showing the mechanism in a fully reclined position.

Footrest linkage 90 is suspended from the front of seat link 22 as perhaps best shown in FIGS. 2 and 3. Footrest linkage 90 comprises conventional scissor-type linkage which is only representative of the various types of footrest actuating mechanisms which may be employed in the present invention. Footrest linkage 90 comprises a rear footrest link 92 and a front footrest link 94 connected together at a pivot connection 96. Rear footrest link 92 is further connected to seat link 22 at a pivot connection 98 and front footrest link 94 is further connected to a footrest support link 100 at a pivot connection 102. Footrest linkage 90 further comprises footrest support links 104, 106 connected together at a pivot connection 108. Rear footrest support link 104 is further connected to seat link 22 at a pivot connection 110 and front footrest support link 106 is further connected to footrest link 100 at a pivot connection 112.

The pairs of footrest links 92, 94 and 104, 106 are pivotally connected together at a pivot connection 114 between links 94 and 104. Stop studs 116, 118 are provided for respectively providing stops for footrest linkage 90 in the retracted position as shown in FIG. 1 and the extended position as shown in FIG. 2. In this regard, stop stud 116 engages footrest link 100 in the retracted position and stop stud 118 engages front footrest link 94 in the extended position. A legrest support 120 is also provided and pivotally connected to front footrest support link 106 at a pivot connection 122 and actuated into position by a connecting 10 link 124 attached to legrest support link 120 at a pivot connection 126 and to footrest link 100 at a pivot connection 128.

Footrest actuating linkage 130 is provided and generally connected between seat link 22, base member 24 and footrest linkage 90 for actuating footrest linkage 90 into an extended position in going from the fully upright position shown in FIG. 1 to the intermediate or T.V. position shown in FIG. 2. Specifically, footrest actuating linkage 130 comprises link members 132, 134, 136 connected between seat link 22, base member 24 and rear footrest link 92. Link member 132 is connected by a pivot connection 138 to rear footrest link 92 and connected to link members 134, 136 at a pivot connection 140. Pivot connection 140 is directly connected to one end of each of link members 132 and 134 and connected to a slot 142 in link member 136 by a pin 144. Pin 144 essentially allows movement of the ends of link members 132 and 134 with respect to link member 136 during actuation of footrest linkage 90. A lower end of link member 136 is connected to base member 24 by a pivot connection 146 and an upper end of link member 134 is connected to seat link 22 by a pivot connection 148.

Linkage Mechanism of the Second Embodiment

Figure 4:
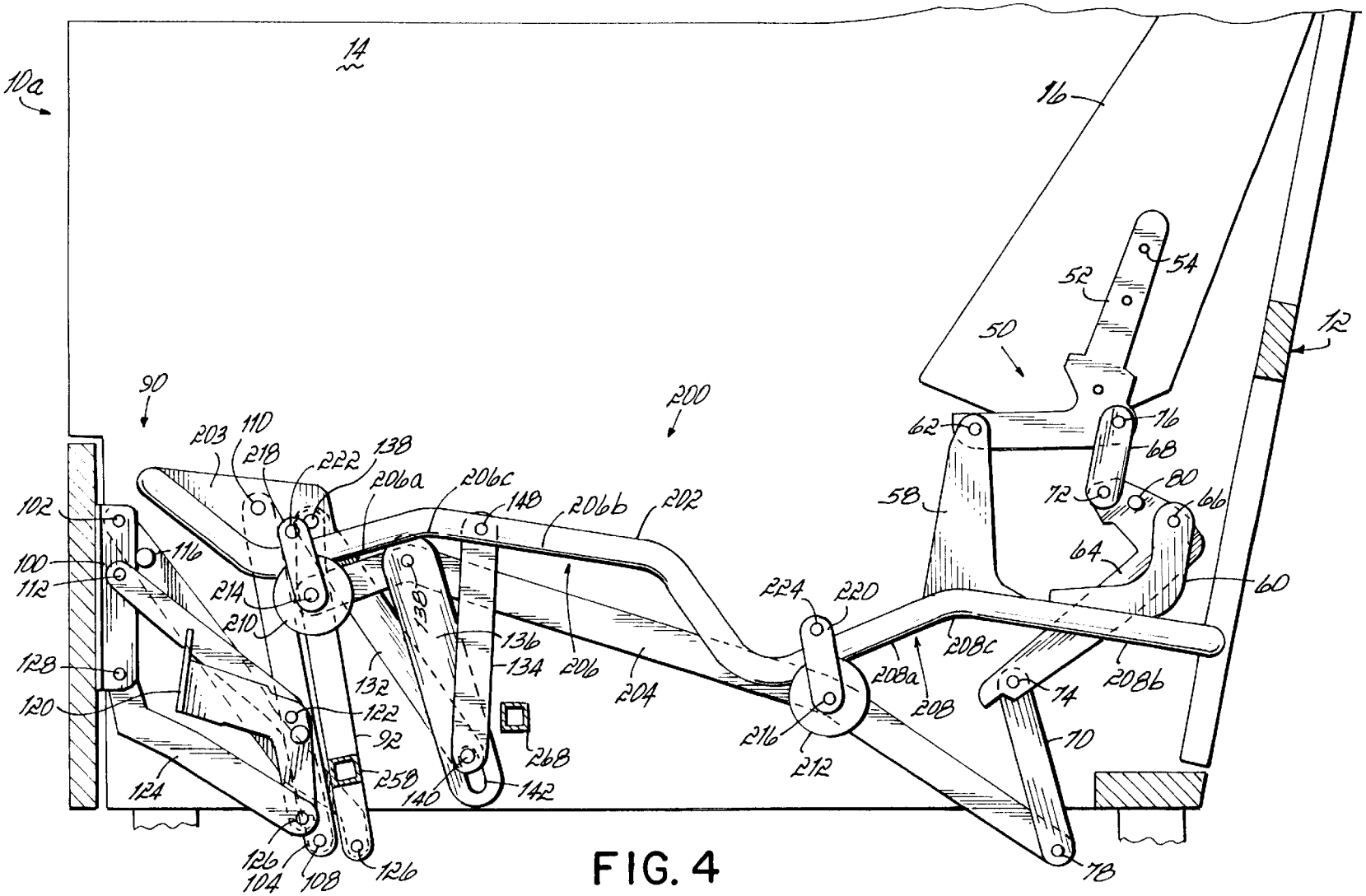
FIG. 4 is a side cross-sectional view of a schematically illustrated furniture similar to FIG. 1, but illustrating a second embodiment of the reclining mechanism.

FIGS. 4–7 illustrate a second embodiment of the present invention. FIG. 4 shows a reclining furniture item 10*a* which again may be a chair, sofa, sectional or the like and which generally comprises a stationary frame structure 12 including an arm frame portion 14 and a backrest 16 which is moveable with respect to a seat (see FIG. 1). The furniture item 10' further includes an extendable and retractable footrest 18. The footrest and backrest linkage associated with furniture item 10*a* is the same as that described above in connection with the first embodiment and therefore like numbers have been shown in FIGS. 4–6. It will be noted, however, that the seat supporting member 202 in this embodiment requires a front plate 203 affixed thereto as shown to provide connection points for links 92 and 104. The description of backrest linkage 50, footrest linkage 90 and footrest actuating linkage 130 found above with reference to FIGS. 1–3 may be referred to and will therefore not be repeated here.

The main difference between the first and second embodiments lies in the roller and track system. In the second embodiment, a moveable seat member 202 is provided as well as a stationary base member 204 which may be rigidly affixed to arm frame portion 14 as in the first embodiment. In the second embodiment, however, seat member 202 includes a pair of tracks 206, 208 each including first and second sloped track sections 206*a*, 206*b* and 208*a*, 208*b* each separated by respective generally angled intersections 206*c*, 208*c*. Rollers 210, 212 are mounted for rotation on stationary base member 204 by respective roller mounts 214, 216. Like the first embodiment, each roller 210, 212 includes a respective guide member 218, 220. Roller followers 222, 224 are mounted for rotation at the upper ends of each guide member 218, 220. It will therefore be appreciated that rollers 210, 212 roll along lower surfaces of tracks 206, 208 while roller followers 222, 224 travel along corresponding upper surfaces of seat member 202 during movement between the fully upright, intermediate and fully reclined positions to be described below. Also like the first embodiment, followers 222, 224 may, but do not have to, contact the upper surface of seat member 202. Their main function is to prevent lifting of the seat.

Figure 7:
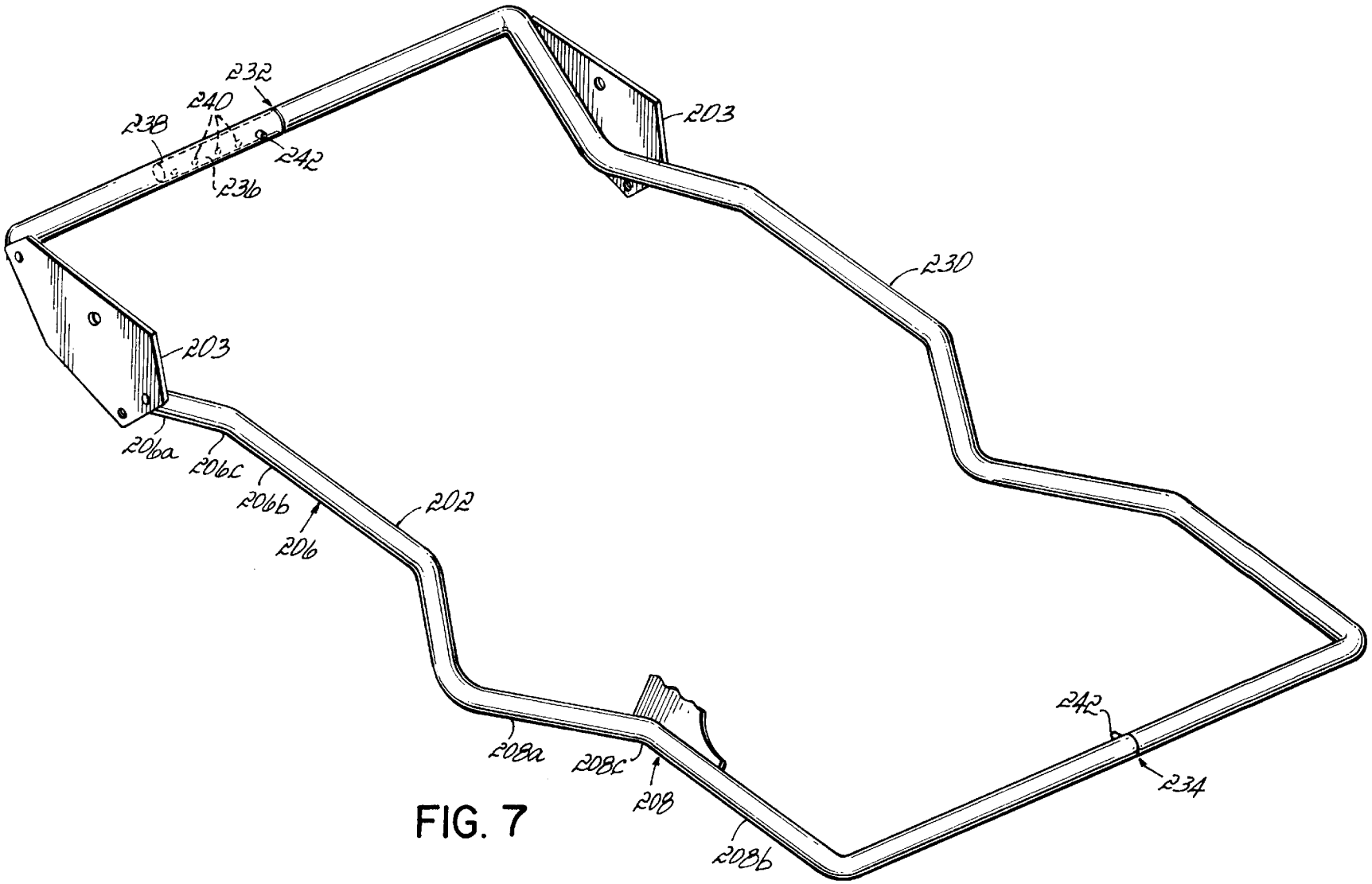
FIG. 7 is a perspective view of a tubular seat frame uncorporating side track systems utilized in the reclining mechanism of the second embodiment.

As shown in FIG. 7, seat member 202, which forms part of reclining mechanism 200 on each side of furniture item 10*a* is preferably formed for adjustable connection to another seat member 230 which is a mirror image of seat member 202 for use in connection with another reclining mechanism on the opposite side of furniture item 10*a*. As mentioned above, these mechanisms are also mirror images of each other and therefore the full description of each mechanism is not necessary. The adjustable connection made between seat member 202, 230 is preferably formed through telescopic connections 232, 234. This type of connection is preferred because seat members 202, 230 are formed from steel tubular members which may be easily bent to the required shape and with the necessary angled track sections described above. Each adjustable connection 232, 234 may be formed with respective telescopic portions 236, 238 of seat members 202, 230 connected by way of a pin 242 extending through one of a series of aligned holes 240 extending through both telescopic portions 236, 238. Of course, other adjustable connections may be used which allow seat members 202, 230 to be adjusted with respect to each other to correspond in size to the particular furniture item 10*a* utilizing mechanism 200 (FIG. 4).

Seat Actuating Mechanism

Figure 8:
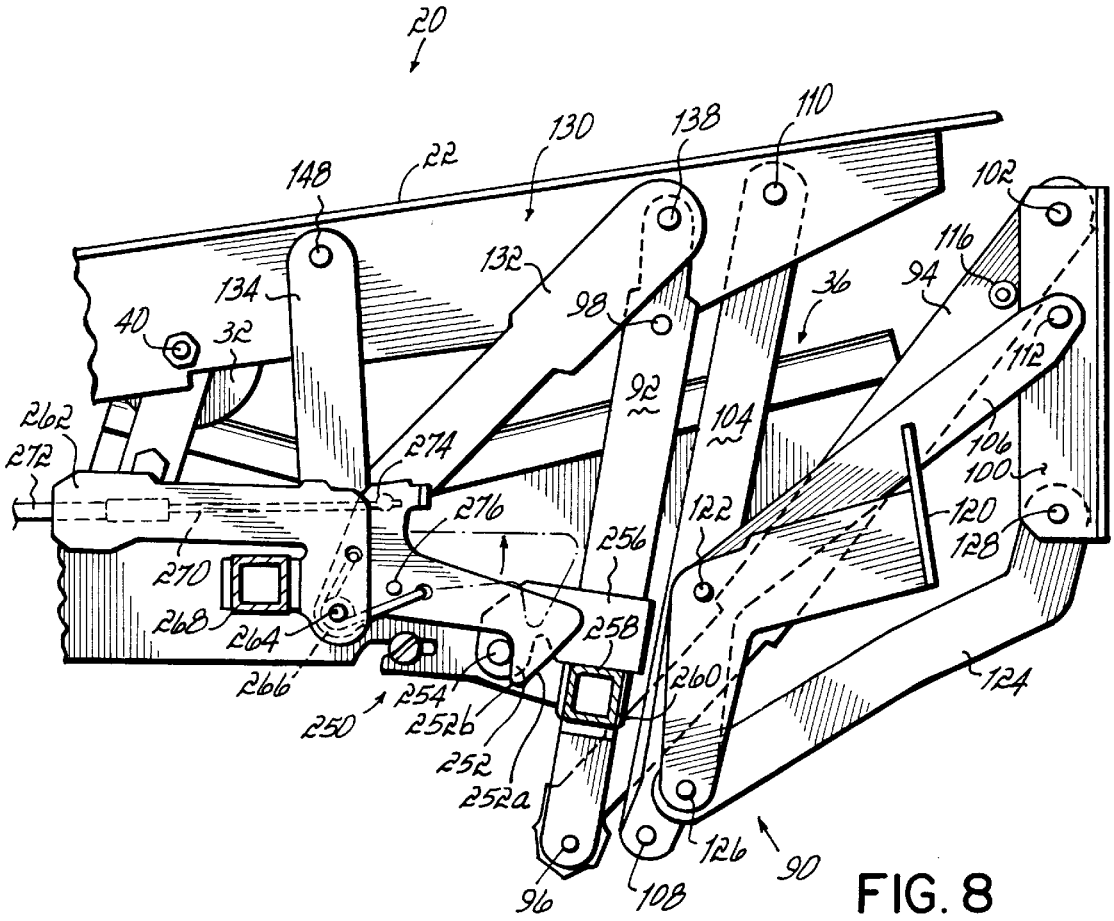
FIG. 8 is an enlarged view of the front of the mechanism of FIG. 1 including the latch mechanism.

FIG. 8 illustrates a seat actuating mechanism 250 which is the presently preferred manner of actuating each of the linkage mechanisms 20, 200 described hereinabove. It will be appreciated that other types of conventional actuating or latching mechanisms may be substituted for mechanism 250. Although mechanism 250 is specifically shown and will be described in connection with linkage mechanism 20, the same actuating mechanism 250 is utilized and mounted to the same components in mechanism 200.

Latch or mechanism 250 comprises a hook latch 252 which engages a pin 254 when footrest linkage 90 is in the retracted position shown in FIG. 8. This corresponds to furniture item 10 (FIG. 1) being in a fully upright position. Pin 254 is attached to a mounting bracket 256 which, in turn, is attached to a mounting tube 258. Tube 258 is secured to rear footrest link 92 by a bracket 260. The opposite end of tube 258 is secured to the corresponding rear footrest link of the linkage mechanism (not shown) on the opposite side of the furniture item. Hook latch 252 is attached to a mounting bracket 262 at a pivot connection 264 and is normally biased downward by a torsion spring 266 connected between hook latch 252 and bracket 262. Bracket 262 is mounted to a tube 268 connected to base member 24 and to the corresponding base member of the linkage mechanism (not shown) located on the opposite side of the furniture item. A cable 270 forming part of a conventional cable assembly 272 is attached to a pin 274 at the upper end of hook latch 252. A conventional operating handle (not shown) is mounted on the side of the furniture item and is operative to pull cable 270 thereby pivoting hook latch 252 upwardly or counterclockwise about pivot connection 264 as shown in phantom to release engagement with pin 254. This allows footrest linkage 90 to extend to the position shown in FIG. 2 as will be described below. A stop pin 276 is provided on hook latch 252 and contacts bracket 262 to limit upward movement of hook latch 252.

When hook latch 252 is subsequently released by the seat occupant, it is biased downwardly to the position shown in solid in FIG. 8. When the seat occupant then pushes the footrest and footrest linkage 90 into the retracted position shown in FIG. 8, pin 254 engages cam surface 252*a* moving hook latch 252 upwardly until pin 254 moves behind the lower end 252*b* thereof as shown. At this point, latch 252 is biased downwardly into the latched position by spring 266.

Linkage Mechanism of the Third Embodiment

Figure 9:
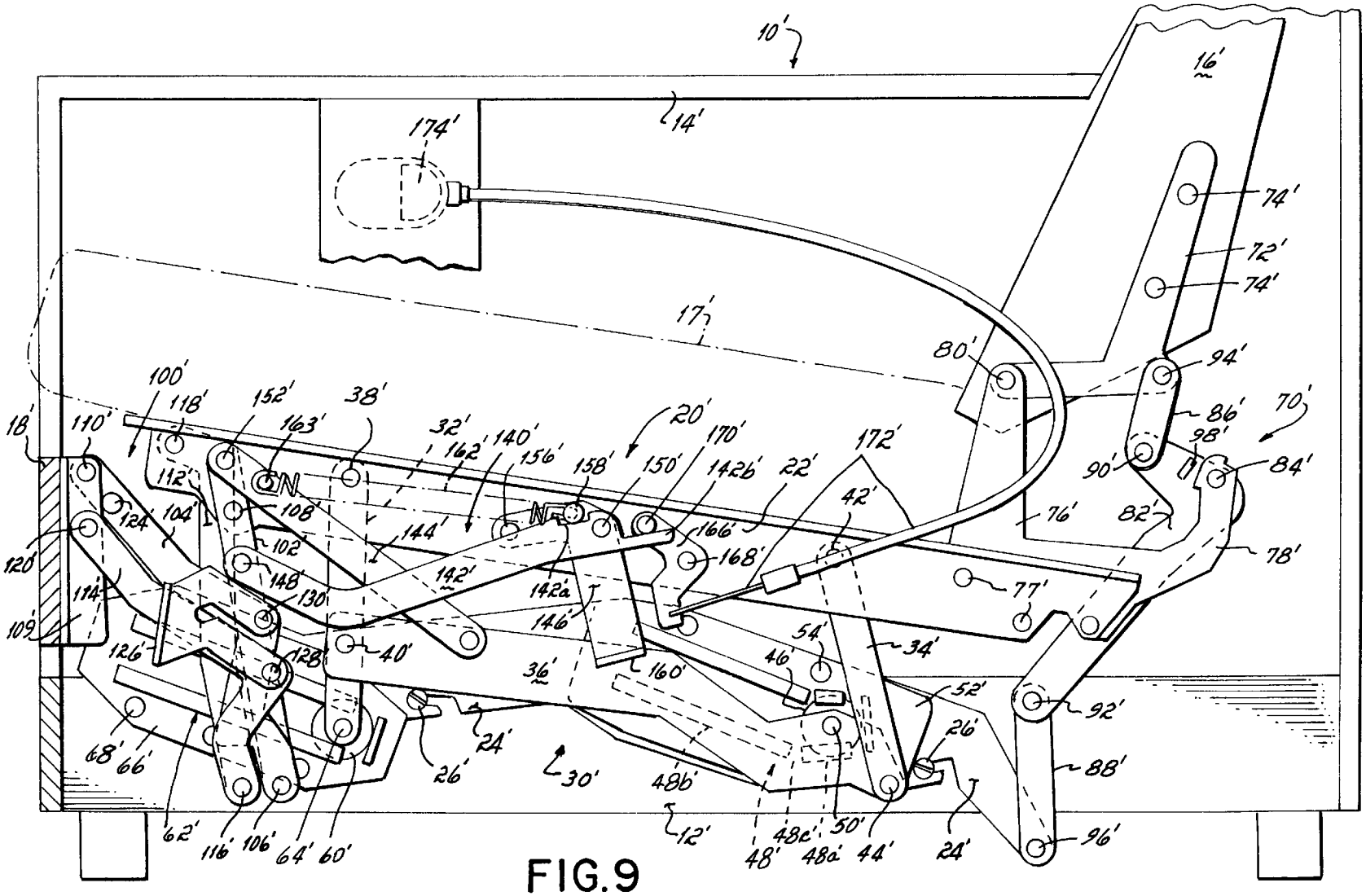
FIG. 9 is a side cross sectional view of a schematically illustrated furniture item incorporating a reclining mechanism constructed in accordance with a third embodiment of this invention.

Referring generally to FIG. 9, an item of furniture 10' is shown and includes a stationary base frame 12' having an arm frame portion 14'. Furniture item 10' further includes a movable backrest 16' and a movable seat 17' and footrest 18'. Furniture item 10' may be a reclining chair or sofa or any type of so-called action furniture which utilizes a seat, backrest and footrest movable between upright, intermediate or TV, and fully reclined positions. To accomplish the movement of furniture item 10' between these three positions, furniture item 10' incorporates an improved linkage mechanism 20' constructed in accordance with the present invention. Only one mechanism 20' is shown and described with the understanding that furniture item 10' includes another such mechanism on the other side being a mirror image of mechanism 20'.

The preferred embodiment of linkage mechanism 20' includes a movable seat link 22' and a stationary base member or link 24'. Base member 24' is rigidly affixed to chair frame 12' by suitable fasteners 26'. Seat link 22' is part of seat supporting linkage 30' which further includes a front pivot link 32', a rear pivot link 34' and a connecting link 36'. Front pivot link 32' is pivotally connected to seat link 22' and connecting link 36' by respective pivots 38', 40'. At a rear end of connecting link 36', rear pivot link 34' is pivotally connected to seat link 22' and to connecting link 36' by respective pivots 42', 44'. In accordance with the general principles of this invention, a first roller 46' and first track 48' are provided and generally connected to base member 24' and to seat supporting linkage 30'. First track 48' includes first and second track sections 48*a'*, 48*b'*.

First track section 48*a'* is sloped downwardly from rear to front while second track section 48*b'* is sloped upwardly from rear to front. Roller 46' is mounted for rotational movement to connecting link 36' at a roller pivot mount 50'. First track 48' is rigidly affixed to base member 24' by a mounting plate 52' connected, for example, to base member 24' by rivets 54'. A second roller 60' also generally connects seat supporting linkage 30' to base member 24', and specifically is mounted by a pin 64' to the lower end of link 32'. In this regard, second roller 60' is disposed within a second track 62' located generally at the front of mechanism 20'. Second track 60', however, is simply a straight track that is upwardly sloped from rear to front. Like first track 48', second track 60' is rigidly affixed to base member 24', preferably by a mounting plate 66' and rivets 68'.

Linkage mechanism 20' further includes backrest linkage 70' generally connected between backrest 16', seat link 22' and base member 24'. Backrest linkage 70' supports the backrest frame 16' for pivotal movement relative to seat link 22' and seat 17' attached thereto. Backrest linkage 70' includes a backrest link 72' rigidly affixed to backrest frame 16' by suitable fasteners 74'. Many different configurations for backrest linkage 70' may be chosen and utilized in linkage mechanism 20' of the present invention. As presently contemplated, backrest linkage 70' includes a bracket, having a pair of support members 76', 78', and rigidly affixed to a rear end of seat link 22'. This rigid fixation may be accomplished by welding or with rivets 77' affixed to the bracket as shown. An upper end of support member 76' is connected to backrest link 72' by a pivot connection 80'. An upper end of support member 78' is connected to a backrest actuating link 82' by a pivot connection 84'. Backrest actuating link 82' is part of further actuating and supporting linkage including upper and lower links 86', 88' connected by respective pivot connections 90', 92' at opposite ends of actuating link 82'. Upper actuating link 86' is also connected to backrest link 72' by a pivot connection 94' and lower actuating link 88' is also connected to base member 24' by a lower pivot connection 96' to complete the connection between backrest frame 16', seat link 22' and base member 24' or frame 12'. Backrest actuating link 82' further includes a stop member 98' for limiting reclining motion of backrest frame 16'.

Figure 10:
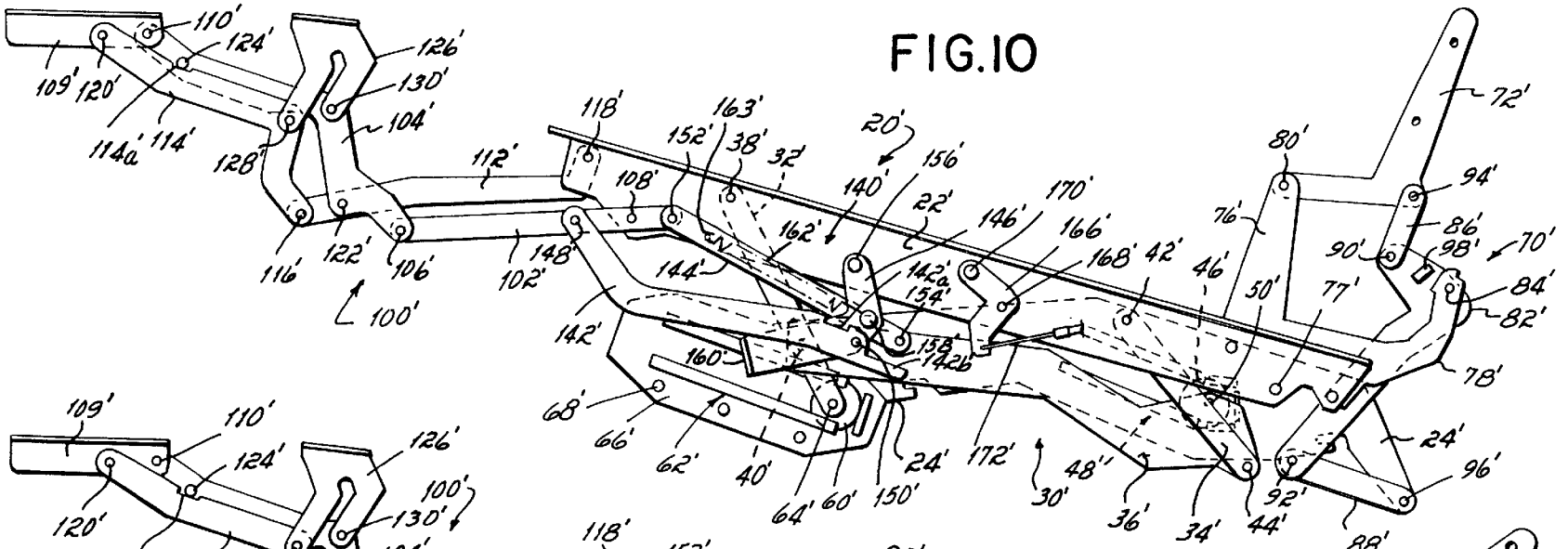
FIG. 10 is a side elevational view of the mechanism shown in FIG. 9, eliminating the furniture item for clarity, and showing the mechanism in an intermediate T.V. position.
Figure 11:
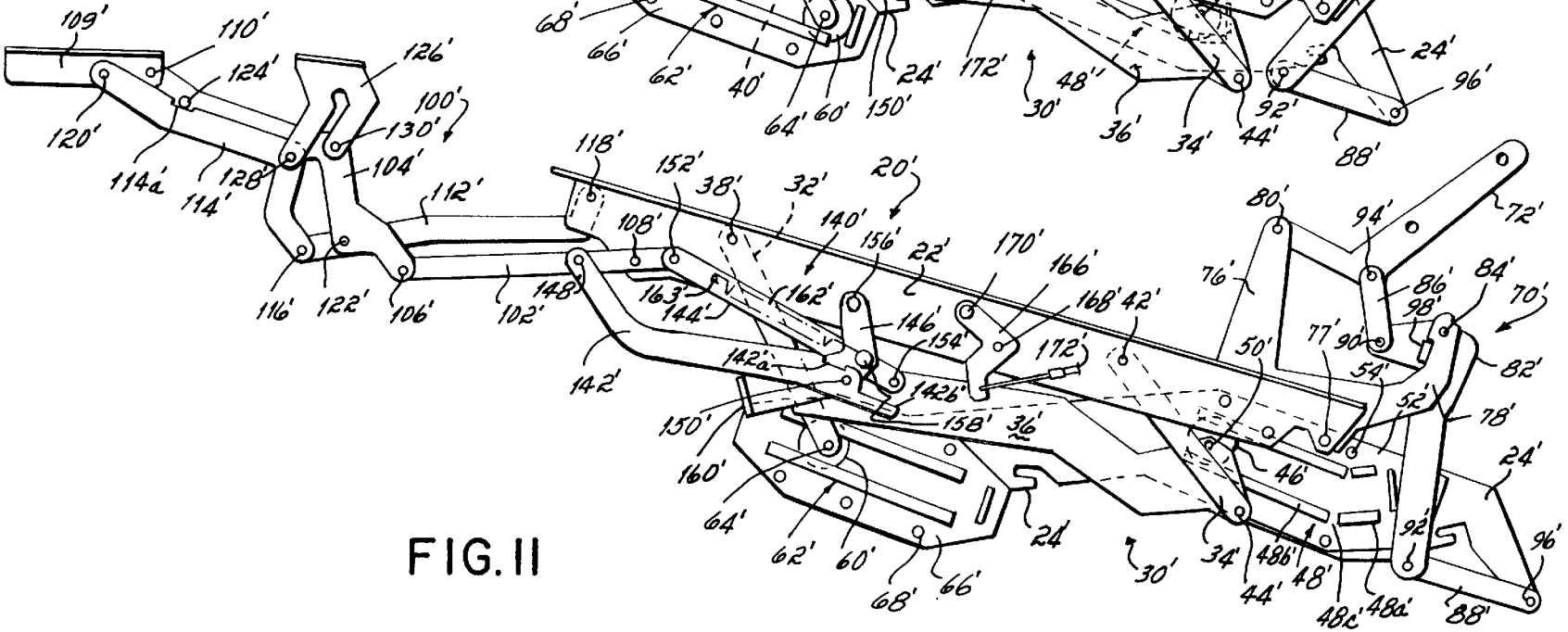
FIG. 11 is a side elevational view of the mechanism shown in FIGS. 9 and 10 but showing the mechanism in a fully reclined position.

Footrest linkage 100' is suspended from the front of seat link 22' as perhaps best shown in FIGS. 10 and 11. Footrest linkage 100' comprises conventional scissor type linkage which is only representative of the various types of footrest actuating and supporting mechanisms which may be employed in practicing the present invention. Footrest linkage 100' comprises a rear footrest link 102' and a front footrest link 104' connected together at a pivot connection 106'. Rear footrest link 102' is further connected to seat link 22' at a pivot connection 108' and front footrest link 104' is further connected to a footrest support link 109' at a pivot connection 110'. Footrest linkage 100' further comprises footrest support links 112', 114' connected together at a pivot connection 116'. Rear footrest support link 112' is further connected to seat link 22' at a pivot connection 118' and front footrest support link 114' is further connected to footrest support link 109' at a pivot connection 120'.

The pairs of footrest links 102', 104' and 112', 114' are pivotally connected together at a pivot connection 122' between links 104' and 112'. A stop stud 124' is provided on link 104' for stopping footrest linkage 100' at the extended position shown in FIGS. 10 and 11 by bearing against stop portion 114*a'* of footrest support link 114'. A leg rest support or mid ottoman link 126' is provided and connected by respective pivot connections 128', 130' to links 114' and 104'.

Footrest actuating linkage 140' is provided and is generally connected between seat link 22', seat supporting linkage 30' and footrest linkage 100' for actuating footrest linkage 100' into an extended position in going from the fully upright position shown in FIG. 9 to the intermediate or TV position shown in FIG. 10. Specifically, footrest actuating linkage 140' includes link members 142', 144' and 146'. Link member 142' is connected by respective pivots 148', 150' to rear footrest actuating link 102' and to link member 146' of footrest actuating linkage 140'. Link member 144' is connected by respective pivots 152' and 154' to the rear end of rear footrest actuating link 102', on the other side of pivot 108' from pivot 148'. The opposite end of link member 144' is connected by pivot 154' to connecting link 36' of seat supporting linkage 30'. Finally, link member 146' of footrest actuating linkage 140' is connected at one end to seat link 22' by a pivot 156'. A stop stud 158' is provided on link member 146' and acts as a stop against a stop portion 142*a'* of link member 142' when footrest linkage 100' is in the fully retracted position as shown in FIG. 9. Link member 146' is generally L-shaped and, at the end opposite to pivot 156', link member 146' includes a mounting portion 160' for attaching one end of a tube (not shown) which may have its other end attached to a like mechanism on the opposite side of furniture item 10' (FIG. 9).

Finally, a coil spring 162' is connected between a pin 163' on a front portion of footrest actuating link 144' and stop stud 158' of footrest actuating link 146'. As will be appreciated from the further description provided below, spring 162' assists in opening mechanism 20' up into the extended position shown in FIG. 10. To initiate the actuation of mechanism 20', a chair actuating link 166' is pivotally connected to seat link 22' by pivot connection 168'. A pin 170' normally rests against an end portion 142*b'* of footrest actuating link 142' when mechanism 20' is fully retracted and chair 10' is fully upright as shown in FIG. 9. A cable 172' is connected to the opposite end of chair actuating link 166' from pin 170' and is associated with a typical latch mechanism 174', for example, that may have a movable handle or latch on the outside of the chair for a seat occupant to grasp and pull.

Operation

Referring again to FIG. 1, furniture item 10 is in an initial fully upright position with seat actuating mechanism 250 latched in place to prevent reclining motion. Rollers 30, 32 are positioned at the upper ends of the first sloped track sections 34*a*, 36*a*. When seat actuating mechanism 250 is released as described above, the weight of the seat occupant forces rollers 30, 32 and the attached seat link 22 to move downwardly and forwardly until rollers 30, 32 reach the respective intersections 34*c*, 36*c* of track sections 34*a*, 34*b* and 36*a*, 36*b*. During this same forward and upward movement, seat link 22 will rotate footrest actuating linkage 130 so as to extend footrest linkage 90. Specifically, link member 132 will pull rearwardly on pivot connection 138 thereby rotating rear footrest link 92 counter-clockwise about its pivot connection 98 to seat link 22 until stop stud 118 is engaged with front footrest link 94 as shown in FIG. 2. To move furniture item 10 into a fully reclined position, the seat occupant simply places rearward pressure on the seat back 16 (FIG. 1). This moves seat link 22 in a forward direction as rollers 30, 32 roll upwardly along track sections 34*b*, 36*b*. To move mechanism 20 back into the intermediate position shown in FIG. 2, the seat occupant simply releases pressure from the backrest 16 (FIG. 1). This allows rollers 30, 32 to roll back down track sections 34*b*, 36*b* to angled intersections 34*c*, 36*c*. To move mechanism 20 back into the fully upright position shown in FIG. 1, the seat occupant presses down on the footrest 18 to retract footrest linkage 90 and force rollers 30, 32 up track sections 34*a*, 36*a* until latch mechanism 250 engages.

Figure 5:
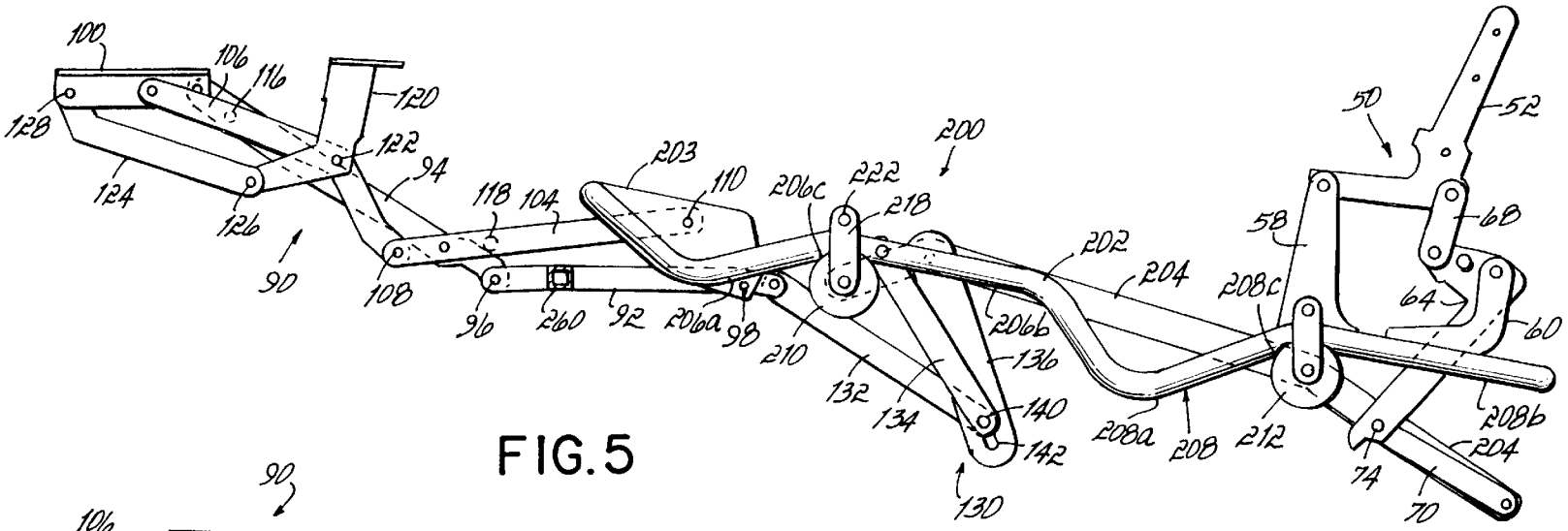
FIG. 5 is a side elevational view of the reclining mechanism shown in FIG. 4 but eliminating the furniture item for clarity and showing the reclining mechanism in an intermediate or T.V. position.
Figure 6:
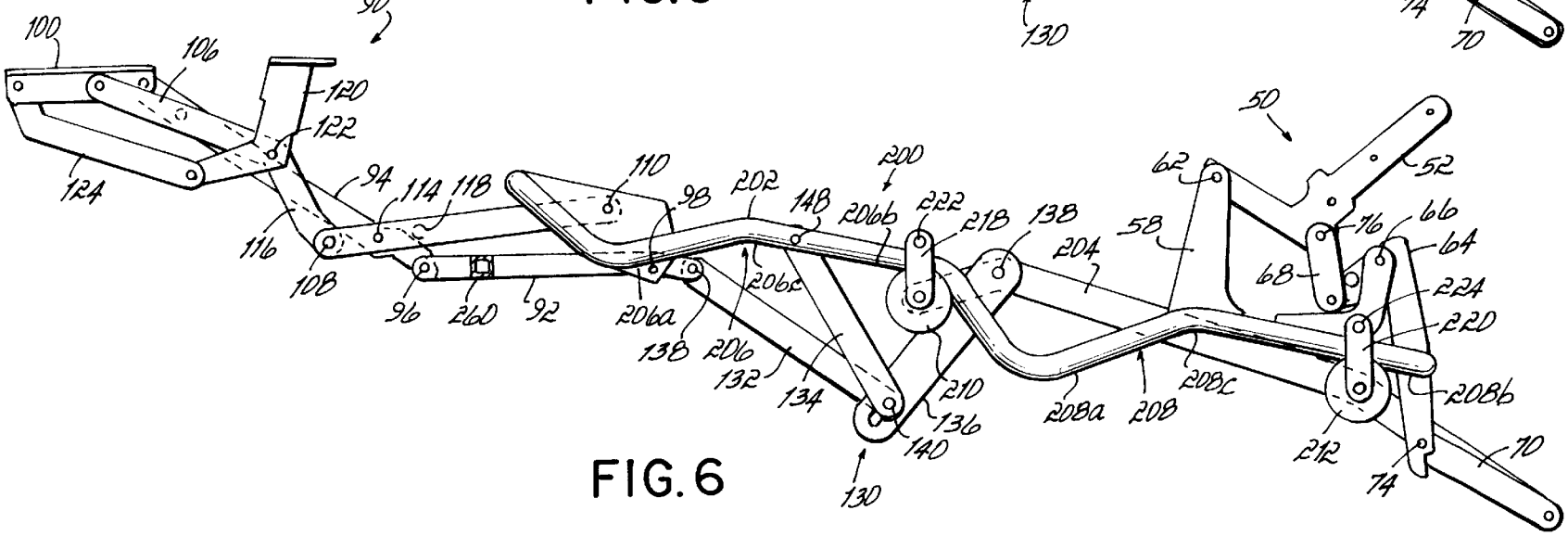
FIG. 6 is a side elevational view of the reclining mechanism of FIG. 5 but shown in a fully reclined position.

The operation of the second embodiment shown in FIGS. 4–6 is very similar to the operation of the first embodiment. The difference is that the track sections are moving along stationary rollers instead of vice versa. Thus, when seat actuating mechanism 250 is released by the seat occupant, seat member 202 will move downwardly and forwardly as track sections 206*a*, 208*a* move along stationary rollers 210, 212 until intersections 206*c*, 208*c* reach rollers 210, 212, as shown in FIG. 5. Like the first embodiment, to move from the intermediate or T.V. position, as shown in FIG. 5, to the fully reclined position shown in FIG. 6, the seat occupant places rearward pressure on the seat back (FIG. 4). This forces track sections 206*b*, 208*b* to move upwardly along rollers 210, 212 until stop stud 80 contacts link 68 as shown in FIG. 6. Movement back into the intermediate or T.V. position and into the fully upright position is initiated and accomplished in the same manner as described above with respect to the first embodiment.

Referring now to FIGS. 9–11, the operation of furniture item 10' as constructed in accordance with the third embodiment is initiated when the user actuates latch mechanism 174' to pull cable 172'. This rotates chair actuating link 166' counterclockwise as shown in FIG. 9 to move the rear end of footrest actuating link 142' downwardly and pivot link 146' clockwise about pivot connection 156' with seat link 22'. With the assistance of spring 162' as well as the weight of the seat occupant, footrest actuating linkage 140' and footrest linkage 100' extends to the position shown in FIG. 10. During this movement, front and rear pivot links 32', 34' of seat supporting linkage 30' rotate counterclockwise about their respective bottom pivot points 64' and 44'. The upper ends of pivot links 32', 34' move generally in a forward direction and thereby move seat link 22' also in a forward direction. At the same time, backrest 16' becomes further angled rearward from seat 17' with the bottom of backrest 16' also moving in a forward direction with seat 17'. During this movement from the fully upright position to the intermediate or TV position, first roller 46' moves down first track section 48*a'* of track 48' as seat supporting linkage 30' and, more specifically, connecting link 36' moves generally in a forward direction with seat link 22'. At the intermediate or TV position shown in FIG. 10, roller 46' stops at the generally angled intersection of 48*c'* and stop stud 124' bears against stop position 114*a'* of footrest link 114' to stop further extension of mechanism 20'.

To move furniture item 10' to a fully reclined position, as shown in FIG. 11, the seat occupant simply places rearward pressure on seat back 16' (FIG. 9). This moves seat link 22' in a forward direction and causes rollers 46', 60' to respectively roll upwardly along section 48*b'* of first track 48' and along the length of track 62'. When stop stud 98' engages against support member 78', mechanism 20' is retained against further extension and rollers 46', 60' stop at or near the forward ends of respective tracks 48', 62'. To move mechanism 20' back into the intermediate or TV position shown in FIG. 10, the seat occupant simply releases pressure from the backrest 16' (FIG. 9). This allows rollers 46', 60' to roll back down track section 48*b'* and track 62' to the respective positions shown in FIG. 10. To move mechanism 20' back into the fully upright position shown in FIG. 9, the seat occupant applies downward pressure on footrest 18' thereby retracting footrest linkage 100' and reversing the motion of mechanism 20' as described above in going from the fully upright to the intermediate or TV position. When front pivot link 32' reaches its original over center position, linkage mechanism 20' is retained in the position shown in FIG. 9.

The present invention has many inventive concepts which, although described with respect to specific preferred mechanisms, may be employed in many different mechanisms having different configurations. For example, the footrest and backrest linkage assemblies described herein are essentially conventional ones and may be modified in many different manners while still retaining the spirit and scope of the inventive concepts which pertain mainly to the track and roller systems disclosed and claimed herein. Thus, while a detailed description of various embodiments of this invention has been provided, Applicant intends to be bound only by the scope of the claims appended hereto.

What is claimed is:

1. A three way reclining mechanism for moving an item of reclining furniture between fully upright, intermediate reclined and fully reclined positions, the mechanism comprising:

a stationary base member;

a seat supporting member;

backrest linkage connected to a rear end of said seat supporting member and including a pivoting backrest link for attachment to a backrest and operable to pivot with respect to said seat supporting member;

a footrest support operatively connected to a forward end of said seat supporting member to allow extension and retraction of said footrest support; and, a roller and track system operatively connected between said stationary base member and said seat supporting member to allow relative forward and rearward movement therebetween, said roller and track system including at least one roller engaging a track and said track including a first section sloped downwardly from rear to front and a second section sloped upwardly from rear to front, said first and second sections being separated by a generally angled intersection, wherein said roller is disposed at an upper end portion of the first track section in the fully upright position, at said intersection in the intermediate reclined position and at an upper end portion of the second track section in the fully reclined position.

2. The mechanism of claim 1 wherein said roller and track system further comprises two rollers and two tracks, said rollers and said tracks being respectively engaged with each other at front and rear locations on said seat supporting member and said base member.

3. The mechanism of claim 1 wherein said track is disposed on said base member and said roller is mounted for rotation to said seat supporting member.

4. The mechanism of claim 3 wherein said base member is a base link adapted for attachment to frame structure of the furniture item and said track is formed on an upper edge of said base member.

5. The mechanism of claim 3 wherein said roller and track system further comprises two rollers and two tracks, said rollers and said tracks being respectively engaged with each other at front and rear locations on said seat supporting member and said base member.

6. The mechanism of claim 1 wherein said roller is part of a roller assembly including a roller follower for moving along an opposite side of said track with respect to said roller.

7. The mechanism of claim 1 wherein said track is disposed on said seat supporting member and said roller is mounted for rotation to said base member.

8. The mechanism of claim 7 wherein said base member is a base link adapted for attachment to frame structure of the furniture item and said track is formed on a lower edge of said seat supporting member.

9. The mechanism of claim 7 wherein said roller and track system further comprises two rollers and two tracks, said rollers and said tracks being respectively engaged with each other at front and rear locations on said seat supporting member and said base member.

10. The mechanism of claim 7 wherein said roller is part of a roller assembly including a roller follower for moving along an opposite side of said track with respect to said roller.

11. The mechanism of claim 1 wherein said seat supporting member is formed as a portion of a tubular seat frame structure.

12. The mechanism of claim 11 wherein said tubular seat frame structure is formed from a plurality tubular members with adjustable connections therebetween to allow size adjustment corresponding to differently sized furniture items.

13. A reclining furniture item movable between fully upright, intermediate reclined and fully reclined positions comprising:

a) a stationary base member;

b) a backrest, a seat and a footrest connected for movement with respect to each other by a pair of reclining mechanisms, each reclining mechanism including:

i) a seat supporting member connected to said seat;

ii) backrest linkage connected to a rear end of said seat supporting member and including a pivoting backrest link connected to said backrest and operable to allow pivoting of said backrest with respect to said seat;

iii) a footrest support operatively connected to a forward end of said seat supporting member and connected to said footrest to allow extension and retraction of said footrest with respect to said seat; and, iv) a roller and track system operatively connected between said stationary base member and said seat supporting member to allow relative forward and rearward movement therebetween, said roller and track system including at least one roller engaging a track said track including a first section sloped downwardly from rear to front and a second section sloped upwardly from rear to front, said first and second sections being separated by a generally angled intersection, wherein said roller is disposed at an upper end portion of the first track section in the fully upright position, at said intersection in the intermediate reclined position and at an upper end portion of the second track section in the fully reclined position.

14. The furniture item of claim 13 wherein said roller and track system further comprises two rollers and two tracks, said rollers and said tracks being respectively engaged with each other at front and rear locations on said s eat supporting member and said base member.

15. The furniture item of claim 13 wherein said track is disposed on said base member and said roller is mounted for rotation to said seat supporting member.

16. The furniture item of claim 15 wherein said base member is a base link attached to frame structure of the furniture item and said track is formed on an upper edge of said base member.

17. The furniture item of claim 15 wherein said roller and track system further comprises two rollers and two tracks, said rollers and said tracks being respectively engaged with each other at front and rear locations on said seat supporting member and said base member.

18. The furniture item of claim 13 wherein said roller is part of a roller assembly including a roller follower for moving along an opposite side of said track with respect to said roller.

19. The furniture item of claim 13 wherein said track is disposed on said seat supporting member and said roller is mounted for rotation to said base member.

20. The furniture item of claim 19 wherein said base member is a base link attached to frame structure of the furniture item and said track is formed on a lower edge of said seat supporting member.

21. The furniture item of claim 19 wherein said roller and track system further comprises two rollers and two tracks, said rollers and said tracks being respectively engaged with each other at front and rear locations on said seat supporting member and said base member.

22. The furniture item of claim 19 wherein said roller is part of a roller assembly including a roller follower for moving along an opposite side of said track with respect to said roller.

23. The mechanism of claim 13 wherein said seat supporting member is formed as a portion of a tubular seat frame structure.

24. The mechanism of claim 23 wherein said tubular seat frame structure is formed from a plurality tubular members with adjustable connections therebetween to allow size adjustment corresponding to differently sized furniture items.

25. A reclining furniture item movable between fully upright, intermediate reclined and fully reclined positions comprising:

a) a stationary base member;

b) a backrest, a seat and a footrest connected for movement with respect to each other by a pair of reclining mechanisms, each reclining mechanism including:

i) a tubular seat supporting member connected to said seat;

ii) backrest linkage connected to a rear end of said seat supporting member and including a pivoting backrest link connected to said backrest and operable to allow pivoting of said backrest with respect to said seat;

iii) a footrest support operatively connected to a forward end of said seat supporting member and connected to said footrest to allow extension and retraction of said footrest with respect to said seat;

iv) at least one roller connected for rotation to said base member; and v) a track formed on said tubular seat supporting member and mounted on said roller, said track including first and second differently sloped sections separated by a generally angled intersection, the first sloped track section being sloped downward from rear to front and the second sloped section being sloped upward from rear to front, wherein said roller is disposed at an end portion of the first sloped track section in the fully upright position, at said intersection in the intermediate reclined position and at an end portion of the second sloped track section in the fully reclined position.

26. The mechanism of claim 25 wherein said base member is a base link attached to frame structure of said furniture item.

27. The mechanism of claim 25 wherein said mechanism further comprises two rollers mounted to said base member two tracks formed on said tubular seat supporting member, said rollers and said tracks being respectively engaged with each other at front and rear locations on said tubular seat supporting member and said base member.

28. The mechanism of claim 25 wherein said roller is part of a roller assembly including a roller follower for moving along an opposite side of said track with respect to said roller.

29. The mechanism of claim 25 wherein said tubular seat supporting member is formed from a plurality tubular members with adjustable connections therebetween to allow size adjustment corresponding to differently sized furniture items.

30. A three way reclining mechanism for moving an item of reclining furniture between fully upright, intermediate reclined and fully reclined positions, the mechanism comprising:

a) a base member;

b) seat supporting linkage;

c) backrest linkage connected to a rear end of said seat supporting linkage and including a pivoting backrest link for attachment to a backrest and operable to pivot with respect to said seat supporting linkage;

d) a footrest support operatively connected to a forward end of said seat supporting linkage to allow extension and retraction of said footrest support; and, e) a roller and track system operatively connected to said base member and said seat supporting linkage to allow relative forward and rearward movement between said base member and a seat adapted to be supported by the seat supporting linkage, said roller and track system including first and second rollers respectively engaging first and second tracks, wherein the first roller moves independently of the second roller during movement of the mechanism between the fully upright and intermediate reclined positions and both the first and second rollers move along the first and second tracks during movement of the mechanism between the intermediate reclined and fully reclined positions.

31. The mechanism of claim 30 wherein said first track is disposed on said base member and first said roller is mounted for rotation to a link in said seat supporting linkage.

32. The mechanism of claim 31 wherein said base member is a base link adapted for attachment to frame structure of the furniture item and said first track is disposed at a rear portion of the base link.

33. The mechanism of claim 30 wherein the second track is formed as a single, straight track.

34. The mechanism of claim 33 wherein the second track slopes upward from rear to front.

35. The mechanism of claim 30 wherein the second roller is connected for rotation to a link in said seat supporting linkage and remains stationary as the mechanism moves between the fully upright and intermediate reclined positions.

36. The mechanism of claim 35 wherein the second roller acts as a pivot point for said seat supporting linkage during movement of the mechanism between the fully upright and intermediate reclined positions.

37. In a three way reclining mechanism for moving an item of reclining furniture between fully upright, intermediate reclined and fully reclined positions, and generally including a base member and a seat supporting member operatively connected together for moving the item of furniture between said positions, wherein the improvement comprises:

a roller and track system operatively connected to said base member and said seat supporting member to allow relative forward and rearward movement between said base member and a seat adapted to be supported by the seat supporting member, said roller and track system including first and second rollers respectively engaging first and second tracks, wherein the first roller moves along the first track as the mechanism moves between each of the fully upright, intermediate reclined and fully reclined positions, while the second roller moves along the second track only during movement of the mechanism between the intermediate reclined and fully reclined positions.

38. The mechanism of claim 37 further comprising seat supporting linkage connected with the seat supporting member wherein the second roller acts as a pivot point for said seat supporting linkage during movement of the mechanism between the fully upright and intermediate reclined positions.

39. The mechanism of claim 37 wherein the first track includes an angled portion at which the first roller rests at the intermediate reclined position.

40. The mechanism of claim 39 wherein the second track is a straight track that slopes upward from rear to front.

41. A reclining furniture item movable between fully upright, intermediate reclined and fully reclined positions comprising:

a) a base member;

b) a backrest, a seat and a footrest connected for movement with respect to each other by a pair of reclining mechanisms, each reclining mechanism including:

i) seat supporting linkage including a seat link connected to said seat;

ii) backrest linkage connected to a rear end of said seat supporting linkage and including a pivoting backrest link connected to said backrest and operable to allow pivoting of said backrest with respect to said seat;

iii) a footrest support operatively connected to a forward end of said seat supporting linkage and connected to said footrest to allow extension and retraction of said footrest with respect to said seat; and, iv) a roller and track system operatively connected to said base member and said seat supporting linkage to allow relative forward and rearward movement between said base member and said seat, said roller and track system including a first roller engaging a first track, wherein the first roller moves independently of the second roller during movement of the mechanism between the fully upright and intermediate reclined positions and both the first and second rollers move along the first and second tracks during movement of the mechanism between the intermediate reclined and fully reclined positions.

42. The furniture item of claim 41 wherein said first track is disposed on said base member and said first roller is mounted for rotation to a link in said seat supporting linkage.

43. The furniture item of claim 42 wherein said base member is a base link attached to frame structure of the furniture item and said first track is disposed at a rear portion of the base link.

44. The mechanism of claim 41 wherein the second track is formed as a single, straight track.

45. The mechanism of claim 44 wherein the second track slopes upward from rear to front.

46. The mechanism of claim 41 wherein the second roller is connected for rotation to a link in said seat supporting linkage and remains stationary as the mechanism moves between the fully upright and intermediate reclined positions.

47. The mechanism of claim 46 wherein the second roller acts as a pivot point for said seat supporting linkage during movement of the mechanism between the fully upright and intermediate reclined positions.

48. The mechanism of claim 47 wherein the second roller remains stationary as the mechanism moves between the fully upright and intermediate reclined positions.

49. In a three way reclining mechanism for moving an item of reclining furniture between fully upright, intermediate reclined and fully reclined positions, and generally including a base member and a seat supporting member operatively connected together for moving the item of furniture between said positions, wherein the improvement comprises:

a roller and track system operatively connected to said base member and said seat supporting member to allow relative forward and rearward movement between said base member and a seat adapted to be supported by the seat supporting member, said roller and track system including at least one roller engaging a track, said track including a first section sloped downwardly from rear to front and a second section sloped upwardly from rear to front, said first and second sections being separated by a generally angled intersection, wherein said roller is disposed at an upper end portion of the first track section in the fully upright position, at said intersection in the intermediate reclined position and at an upper end portion of the second track section in the fully reclined position.

* * * * *